United States Patent [19]

Jarrett, Jr. et al.

[11] 4,344,302

[45] Aug. 17, 1982

[54] THERMAL COUPLING STRUCTURE FOR CRYOGENIC REFRIGERATION

[75] Inventors: Harold M. Jarrett, Jr., Los Angeles; Thomas P. Cotter, Cypress, both of Calif.

[73] Assignee: Hughes Aircraft Company, Culver City, Calif.

[21] Appl. No.: 271,746

[22] Filed: Jun. 8, 1981

[51] Int. Cl.[3] ..... F25D 19/00

[52] U.S. Cl. ..... 62/514 R; 62/383; 165/181; 165/185

[58] Field of Search ..... 62/514 R, 6, 383; 165/82, 181, 185

[56] References Cited

U.S. PATENT DOCUMENTS

| | | | |
|---|---|---|---|
| 2,862,991 | 12/1958 | Reardon | 165/185 |
| 3,160,132 | 12/1964 | Mowatt | 165/185 |
| 3,195,628 | 7/1965 | McAdam | 165/185 |
| 3,306,075 | 2/1967 | Cowans | 62/383 |
| 3,807,188 | 4/1974 | Lagodmos | 62/514 R |

*Primary Examiner*—Ronald C. Capossela

*Attorney, Agent, or Firm*—Allen A. Dicke, Jr.; W. H. MacAllister; W. J. Bethurum

[57] ABSTRACT

Thermal coupling structure 40 has a tubular collar 42 which embraces the cold end of cold finger 14. Fingers 44 on collar 42 resiliently engage within inner wall 24 of dewar 22 so that heat is conducted from device 32 to be cooled through this inner wall 24 to fingers 44, collar 42 to cold finger 16.

11 Claims, 2 Drawing Figures

THERMAL COUPLING STRUCTURE FOR CRYOGENIC REFRIGERATION

BACKGROUND OF THE INVENTION

This invention is directed to a thermal coupling structure particularly for the thermal coupling between a refrigerated sensor and a refrigeration source.

Where a device is to be cooled, it is necessary to provide a thermal pathway between the device and the source of refrigeration. When cryogenic temperatures are to be reached (at or below liquid nitrogen temperatures) thermal coupling becomes more difficult. Several factors present difficult coupling. One of the factors is the need for careful insulation of the cold zone. Such insulation is often in the form of a dewar which is a double walled structure having an evacuated space. The evacuated space reduces thermal loss by conduction. Quite often the dewar is made of glass and in such case, the glass is silvered to minimize thermal conduction by radiation. A cooler is provided within the interior tube of the dewar, and with thermal changes such a glass dewar can receive stresses which are destructive. A metal bellows filled with a thermally conductive material is employed as the thermal coupling device in G. P. Lagodmos, U.S. Pat. No. 3,807,188. C. M. Bower et al, U.S. Pat. No. 3,999,403 teaches a metal bellows which is intended to maintain elasticity at cryogenic temperatures. Both of those patents show a cold finger in which cooling is produced, together with a device to be cooled and the therma coupling bellows. R. C. Longsworth, U.S. Pat. No. 3,728,868 also uses a bellows, see FIG. 3.

Another common thermal connection between a cold finger and a detector is a pad of copper wool loaded with thermal grease positioned between these parts. At cryogenic temperatures the grease freezes making the conductive paths solid. Metal wool is employed to enhance thermal conduction in both P. J. Walsh, U.S. Pat. No. 3,315,478 and in K. E. Nicholds, U.S. Pat. No. 3,704,579. However, in both of these cases the cryogenic liquid product of expansion from a Joule-Thomson valve is discharged directly into the wool where it boils to provide the refrigeration.

K. W. Cowans, U.S. Pat. No. 3,306,075 teaches a plurality of spring fingers around a substantial length of the cold finger in contact with the inner dewar wall to provide thermal contact. In that structure a plurality of metallic cantilevered leaves attached to the finger are resiliently expanded by a separate spring. These leaves extend over substantial length of the cold finger. The problem with this is that most cold fingers are at their lowest temperature closest to their tip, and the temperature is graded along the length thereof.

Each of these prior structures presents one or more problems in thermal coupling so that an improved coupling structure is required.

SUMMARY OF THE INVENTION

In order to aid in the understanding of this invention it can be stated in essentially summary form that it is directed to a thermal coupling structure for cryogenic refrigeration. The coupling structure comprises a collar embraced around the cold end of a cryogenic cold finger in thermal contact therewith. The collar has a plurality of spring fingers extending outwardly therefrom and resiliently engaging on the interior side wall of the dewar, with the device to be cooled mounted on the end wall thereof.

It is thus a purpose and advantage of this invention to provide a thermal coupling structure which couples a refrigeration source to a thermal load with a resilient connection so that thermal connection is maintained even during position changes due to changes in temperature. It is another purpose to provide such a thermal coupling structure wherein loads are limited by the spring stress to prevent damage to the components during the application of assembly forces or during forces which result from thermal changes.

Other purposes and advantages of this invention will become apparent from a study of following portion of the specification, the claims and the attached drawings.

DESCRIPTION OF THE PREFERRED EMBODIMENT

Figure 1:
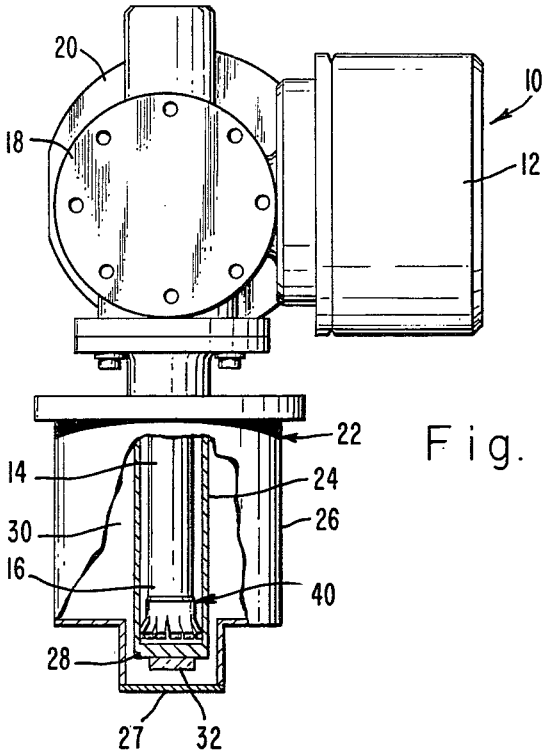
FIG. 1 is a side elevational view of a refrigerator, with parts broken away and parts taken in section showing the termal coupling structure of this invention.

A cryogenic refrigerator is generally indicated at 10 in FIG. 1. The refrigerator 10 is illustrated as being a cryogenic refrigerator of the Stirling cycle. It has a compressor cylinder 12 for compressing the refrigerant gas in a closed cycle. Heat is rejected to the ambient from the high pressure gas. The gas is expanded by means of a piston operating in a cylinder in cold finger 14. The cold gas leaving the cold finger is heat exchanged against the incoming high pressure gas so that refrigeration is produced at the lower end 16 of the cold finger. Mechanism in crank case 18 regulates the motion of the pistons, and the motor 20 drives the mechanism. Such a Stirling refrigerator is conventional. Other refrigerators which produce cooling in a cold finger can also use the coupling structure of this invention.

Dewar 22 provides insulation for the cold finger, to limit the heat exchange from the cold finger so that the principle thermal load on the cold finger is to the device which is to be chilled. Dewar 22 has an outer wall 26 which is closed at the lower end by dewar window 27. The dewar has an inner tube 24 which is closed at its lower end by bottom wall 28. The space between these walls is preferably evacuated to eliminate convective heat transfer. Dewar 22 may be made of glass, in which case it is silvered to reduce radiant heat transfer. The evacuated space 30 is shown.

Device 32 is a structure for which cooling is required. It is a device which is to be cooled by cryogenic refrigerator 10. Device 32 may be a semiconductor device which requires cooling to reduce background electronic noise or may be another type of device which requires cooling for other reasons. Device 32 is secured to bottom wall 28 and is connected electrically or optically or both to other equipment. In the usual case device 32 is a radiation sensor which receives an input signal through window 27 in the optical wavelengths, either visible or invisible, and has a corresponding electrical output signal. In that sense, device 32 is a transducer, but in other applications the device 32 may include amplifier functions as well as other types of electronic and other functions. The cooling of device 32 is accomplished by securing it on bottom wall 28 in a thermally conductive relationship and cooling bottom wall 28 by conducting heat therefrom to the lower end 16, which is the cold end of cold finger 14.

Dewar inner tube wall 24 is formed integrally with and/or is in direct thermal communication with bottom wall 28. Thus, heat extracted from the inner wall 24 cools bottom wall 28. The surrounding outer wall 26 of the dewar 22 and the window 27 enclose device 32, but maintains its thermal isolation as well as possible.

Thermal coupling structure 40 is the structure in accordance with this invention which provides the thermal coupling between dewar wall 22 and the cold lower end 16.

Figure 2:
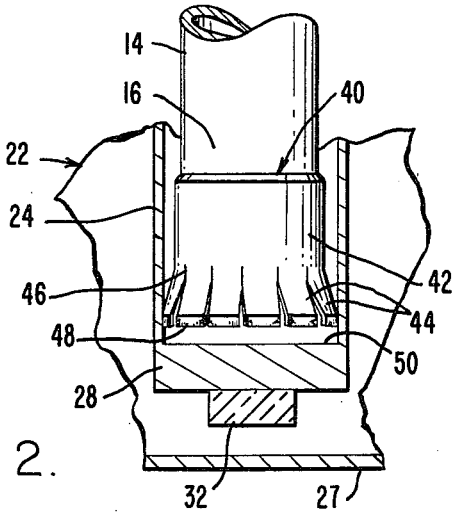
FIG. 2 is an enlarged showing of a portion of the cold finger, dewar and device to be cooled, incorporating the thermal coupling structure of this invention with parts broken away and parts taken in section.

Structure 40 has a tubular collar 42 which closely embraces the lower end 16 of the cold finger. Collar 42 may be adhesively bonded with thermal adhesive to the lower end of the cold finger. Alternatively, it may be soldered thereto or be pressed thereon with an interference fit so that it is in good thermal contact with the cold finger. Usually the cold finger is cylindrical in exterior configuration and collar 42 is a cylindrical tube. Spring fingers 44 are integrally formed with and extend beyond the lower edge of 46 of collar 42. The spring fingers are preferably formed integrally with the tubular collar by slitting a tube down to the collar portion 42. Spring fingers 44 are each bent outwardly with respect to the outer cylindrical surface of collar 42 at a bend line at lower edge 46. In the unstressed position, the fingers extend farther out than the engaged position illustrated in FIGS. 1 and 2. The tips 48 of the fingers are bent inward toward the cylindrical axis of collar 42 to an angle such that when the fingers are inserted into the inner wall 24, they lie flat against that inner dewar wall. This provides maximum thermal contact and thermal transfer.

Thermal coupling structure 40 is made of metal of high thermal conductivity and resiliency. Beryllium-copper is a suitable material. The thickness of the material of fingers 44 is compatible with the stresses involved in bending and with the required thermal flow. The coupling structure 40 is attached to the cold finger 14 with the lower edge 46 of the collar 42 approximately in line with the lower end of the cold finger. However, the collar is positioned on the cold finger so that the ends of the fingers 44 are away from the inner surface 50 of the end wall 28. There is no contact between the fingers 44 and the end of the dewar to relieve any possibility of overstressing or breaking the dewar by axial forces. Thermal conduction is strictly through the fingers 44 to the side wall 24 and thence to the bottom wall 28 and then to the device 32. Bottom wall 28 is also cooled by radiation from the end of the cold finger. To enhance this radiation cooling, the end of the cold finger is blackened to maximize the energy absorption. The inside of collar 42 and the inside of the spring finger 44 may also be blackened, to enhance radiation cooling. There is also convective heat transfer between the surface 50 and the end of the cold finger as well as the collar 42 and its fingers 44. The thermal coupling structure 40 has less thermal mass than a metal wool structure, so that cool down time may be significantly reduced.

In the preferred embodiment illustrated, the collar 42 of coupling structure 40 is shown as being attached to the cold finger, with its spring fingers engaging against the inner wall of the dewar for thermal coupling thereto. It will be appreciated that if the inner wall of the dewar is metallic then the collar of the coupling structure can be attached therein at the lower end thereof by adhesive, soldering or interference fit. In that case, the spring fingers would be bent inwards and downwards so that when the cold finger is inserted, it would engage into the interior of the coupling structure for a thermal coupling therewith.

Some refrigerators have their primary vibration axially of the cold finger so that removal of axial contact and provision of radial contact with a dewar side walls minimizes the vibration transfer to the dewar.

Another important feature is that the spring fingers 44 are laterally resilient to accommodate for misalignment. Slight differences in shapes, dimensions and positions result from ordinary manufacturing tolerances. When the coupling between the cold finger and the dewar is rigid, assembly difficulties can arise. When the dewar is made of glass, breakage sometimes occurs. These problems are enlarged by dimensional changes occasioned by cool down of the cold portions of the system. The provision of only lateral mechanical contact interconnecting between the cold finger and the dewar, and providing resiliency in that contact thus overcomes stress, positional and vibrational problems. However, sufficient thermal conductivity can be achieve so that cool down is even faster than previously experienced.

This invention has been described in its presently contemplated best mode and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A thermal coupling structure for thermal interconnection between a cryogenic cold finger having a side wall and the inner wall of a dewar surrounding the cold finger, said thermal coupling structure comprising:

a collar thermally engaged around said cold finger on the side wall thereof for mechanical support thereby and for thermal connection therewith, said collar being engaged on said spring finger by structure selected from the group consisting of adhesive, solder and interference fit;

a plurality of spring fingers mounted on said collar and in thermal connection therewith, said spring fingers extending outward from said collar to resiliently engage upon the inner wall of the dewar and away from the end wall of the dewar surrounding the cold finger so that heat is transferred from the inner wall of the dewar through said spring fingers and through said collar to the side wall of said cold finger.

2. The thermal coupling structure of claim 1 wherein said collar is a cylindrical tube having an axis, said collar having a lower edge and said spring fingers extending beyond said lower edge.

3. The thermal coupling structure of claim 2 wherein said spring fingers are positioned to extend outwardly from said cylindrical collar at an acute angle with respect to said axis when in a non-stressed position.

4. The thermal coupling structure of claim 3 wherein said spring fingers have tips thereon, said tips being directed toward said axis at an acute angle when said fingers are in an unstressed position and lie substantially parallel to the dewar wall when lying against the dewar wall.

5. The thermal coupling structure of claim 2 wherein said spring fingers and said collar are integrally formed of resilient metallic material and lie substantially parallel to the dewar wall when lying against the dewar wall.

6. The termal coupling structure of claim 5 wherein said spring fingers are positioned to extend outwardly from said cylindrical collar at an acute angle with respect to said axis when in a non-stressed position.

7. The thermal coupling structure of claim 6 wherein said spring fingers have tips thereon, said tips being directed toward said axis at an acute angle when said fingers are in an unstressed position.

8. A thermal coupling structure comprising in combination:

a dewar having a tubular cylindrical interior wall, a bottom secured to said inner wall and enclosing a cold finger chamber, a device to be refrigerated secured to the outside of said bottom outside of said cold finger chamber; and a cylindrical cold finger having a cooled wall extending into said cold finger chamber and spaced from said side wall and said bottom, said thermal coupling structure comprising:

a collar engaging one of said walls by structure selected from the group consisting of adhesive, solder and interference fit, spring fingers mounted on said collar and engaging against said other wall, said collar and said spring fingers being made of metal and said spring fingers being in resiliently stressed condition when in engagement with said wall to provide resilient force between said spring fingers and said wall to maintain thermal contact therebetween.

9. The thermal coupling structure of claim 8 wherein said coupling structure engages said inner wall of said dewar away from its end.

10. The thermal coupling structure of claim 8 wherein said collar and said fingers are formed of unitary metalic material and said fingers each have a tip thereon which is directed at an obtuse angle with respect to its finger.

11. The thermal coupling structure of claim 10 further including in combination a device to be refrigerated mounted on said bottom wall so that it is cooled by conduction through said dewar interior wall.

* * * * *